US005487227A

United States Patent [19]

Marmonier

[11] Patent Number: 5,487,227

[45] Date of Patent: Jan. 30, 1996

[54] SKI BOOT WITH A COLLAR HAVING A CLOSURE SLIDE

[75] Inventor: Gilles Marmonier, Saint Etienne de Crossey, France

[73] Assignee: Skis Rossignol S.A., Voiron, France

[21] Appl. No.: 197,163

[22] Filed: Feb. 16, 1994

[30] Foreign Application Priority Data

Mar. 12, 1993 [FR] France ..... 93 02899

[51] Int. Cl.[6] ..... A43B 5/04; A43C 11/00

[52] U.S. Cl. ..... 36/117; 36/50.1; 36/50.5

[58] Field of Search ..... 36/117, 118, 119, 36/120, 121, 50.1, 50.5

[56] References Cited

U.S. PATENT DOCUMENTS

| | | | |
|---|---|---|---|
| 3,848,347 | 11/1974 | Hanson et al. | 36/120 |
| 3,936,959 | 2/1976 | Hanson et al. | 36/117 X |
| 4,030,214 | 6/1976 | Hanson et al. | 36/118 X |
| 4,073,073 | 2/1978 | Seidel | 36/121 X |
| 4,411,078 | 10/1983 | Bucheder | 36/117 |
| 5,062,225 | 11/1991 | Gorza | 36/117 |
| 5,101,582 | 4/1992 | Pozzobon | 36/117 |
| 5,343,640 | 9/1994 | Mattiuzzo et al. | 36/121 |

FOREIGN PATENT DOCUMENTS

| | | | |
|---|---|---|---|
| 0014124 | 8/1980 | European Pat. Off. | 36/118 |
| 0086908 | 8/1983 | European Pat. Off. . | |
| 1475936 | 4/1967 | France . | |
| 2637612 | 3/1977 | Germany . | |
| 581864 | 9/1958 | Italy | 36/50.1 |
| 52-45436 | 4/1977 | Japan . | |

*Primary Examiner*—Paul T. Sewell
*Assistant Examiner*—BethAnne C. Cicconi
*Attorney, Agent, or Firm*—Kane, Dalsimer, Sullivan, Kurucz, Levy, Eisele & Richard

[57] ABSTRACT

A ski boot comprising a lower shell (1) on which a boot leg (5) in the form of a collar fitted with tightening buckles (6, 7) is articulated. At the rear, the boot leg (5) is provided with a slot (9) extending, from the upper edge, over most of its height. This slot has overthicknesses (12, 13) of matching profile which are fitted into each other under the effect of a slide (20) whose movement closes and opens the slot in the manner of a zipper. This construction allows wide opening of the boot leg for putting the boot on the taking it off.

8 Claims, 4 Drawing Sheets

SKI BOOT WITH A COLLAR HAVING A CLOSURE SLIDE

FIELD OF THE INVENTION

The subject of the present invention is a ski boot with a shell comprising a lower shell intended to surround the foot and the heel and a boot leg in the form of a collar which is articulated on the lower shell and fitted, at the front, with at least one closure and tightening device.

PRIOR ART

This type of boot is well known, in particular from U.S. Pat. Nos. 4,499,676, 4,934,075 and 5,033,210. It has been produced often with a lower shell of variable volume in the form of a boot with four buckles. These boots hold the foot very well and therefore provide good control of the ski and, for this reason, they are especially popular with skiers, despite being difficult to put on. The search for greater ease of putting the boot on has lead to the development of so-called rear entry boots whose boot leg consists of two half-sleeves which fit into each other. This ease of putting the boot on is, however, achieved to the detriment of the adjustment of the boot on the foot, especially at the instep. In order to regain the advantages of the collar whilst retaining the convenience of rear-entry boots, the Applicant has developed a boot whose boot leg includes a collar which is open at the rear with a wide cut allowing insertion of the foot into the boot through the rear, this cut then being closed by a rear cover which fits onto the edges of the cut in the manner of a lid (Patent FR 2,673,081).

Moreover, from Patent FR 1,527,484, a hybrid ski boot made of leather is known, which has both a zipper, as is found on thigh-length boots and, parallel to this zipper, a cable and tension device closure, as might already be found on the ski boot described in Patent CH 406,901. The zipper makes it possible to open the boot wide and to have a short travel of the tightening lever.

A further object of the present invention is to make it easier to put on a collar boot, but by simpler means, without using a rear ,closure cover.

SUMMARY OF THE INVENTION

In the boot according to the invention, the boot leg has, at the rear, at least one slot extending, from the upper edge of the boot leg, over most of the height of the boot leg, toward the heel, the edges of which have an overthickness, the overthickness of one of the edges having a male profile and the overthickness of the other edge having a matching female profile, so as to ensure mutual fastening of these edges by forcible engagement of the male profile into the female profile, and the boot leg includes a closure slide slidingly mounted astride the said edges, the displacement of which along said slot closes and opens the slot in the manner of a zipper.

It is thus possible to open the boot leg of the boot at the rear in order to make it easier to put on, and then to close this boot leg again after the boot has been put on by pulling on the closure slide.

Considering the forces, during skiing, on the interlocking edges of the slot, it is expedient to provide it with a safety slide which can be positioned half way up the slot. This safety slide can be brought automatically into position using a flexible linkage with the closure slide. During opening, the safety slide is pushed downward by the closure slide.

By means of another flexible linkage, the closure slide may furthermore control a clip for locking the boot leg in the descent position.

BRIEF DESCRIPTION OF THE DRAWINGS

The attached drawing represents, by way of example, one embodiment of the boot according to the invention.

DESCRIPTION OF THE PREFERRED EMBODIMENT

Figure 1:
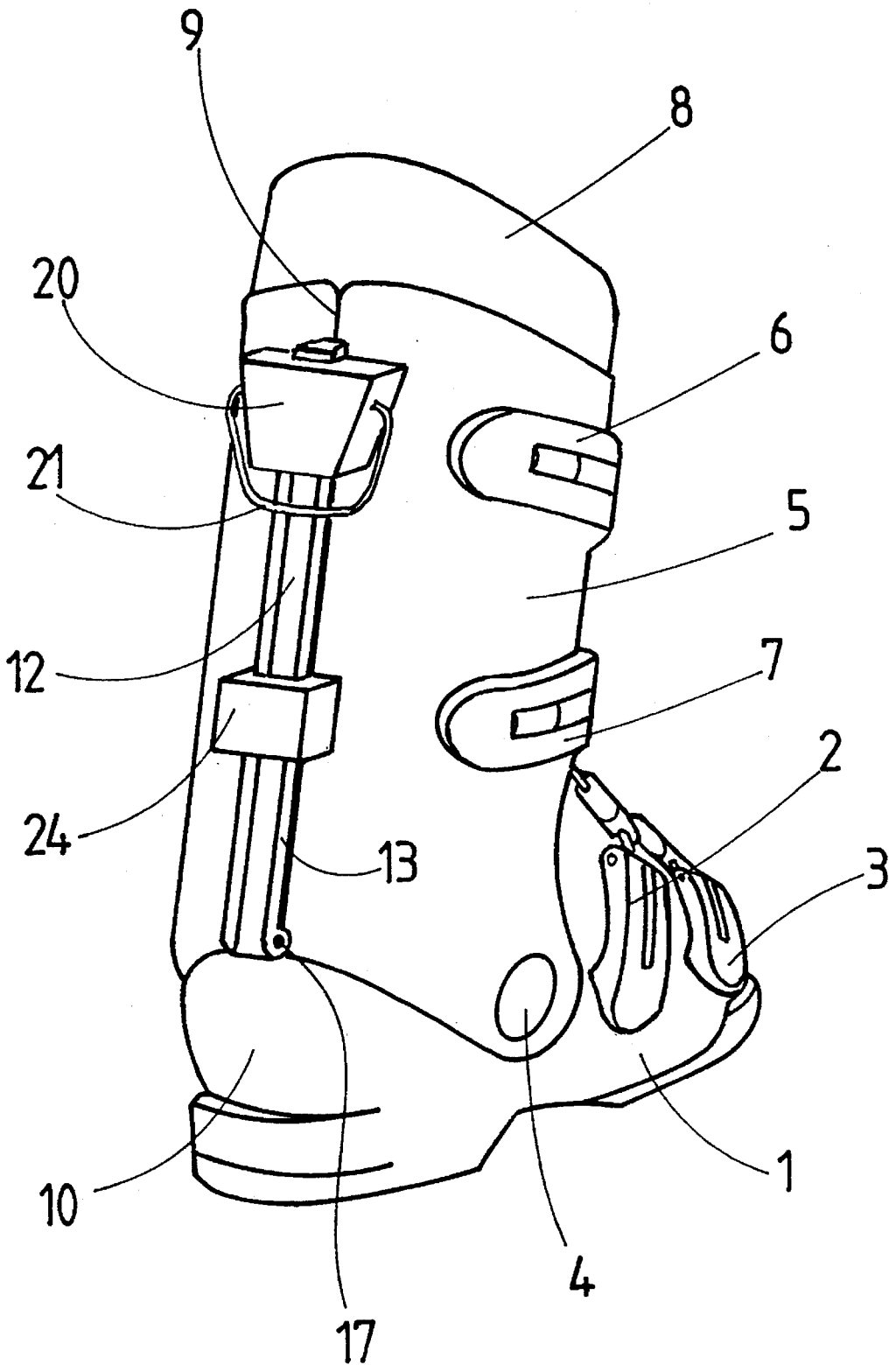
FIG. 1 represents a ¾ rear view thereof, in the closed position.

The boot represented comprises a lower shell 1 with variable volume fitted with two tightening buckles 2 and 3, on which a collar 5 constituting the boot leg of the boot is articulated at 4, which boot leg is fitted at the front with two buckles 6 and 7 for closing it and tightening it around the leg. The shell formed by the lower shell 1 and the collar 5 contains a comfort bootee 8, for example a bootee as described and represented in Patent EP 0,286,586.

Figure 2:
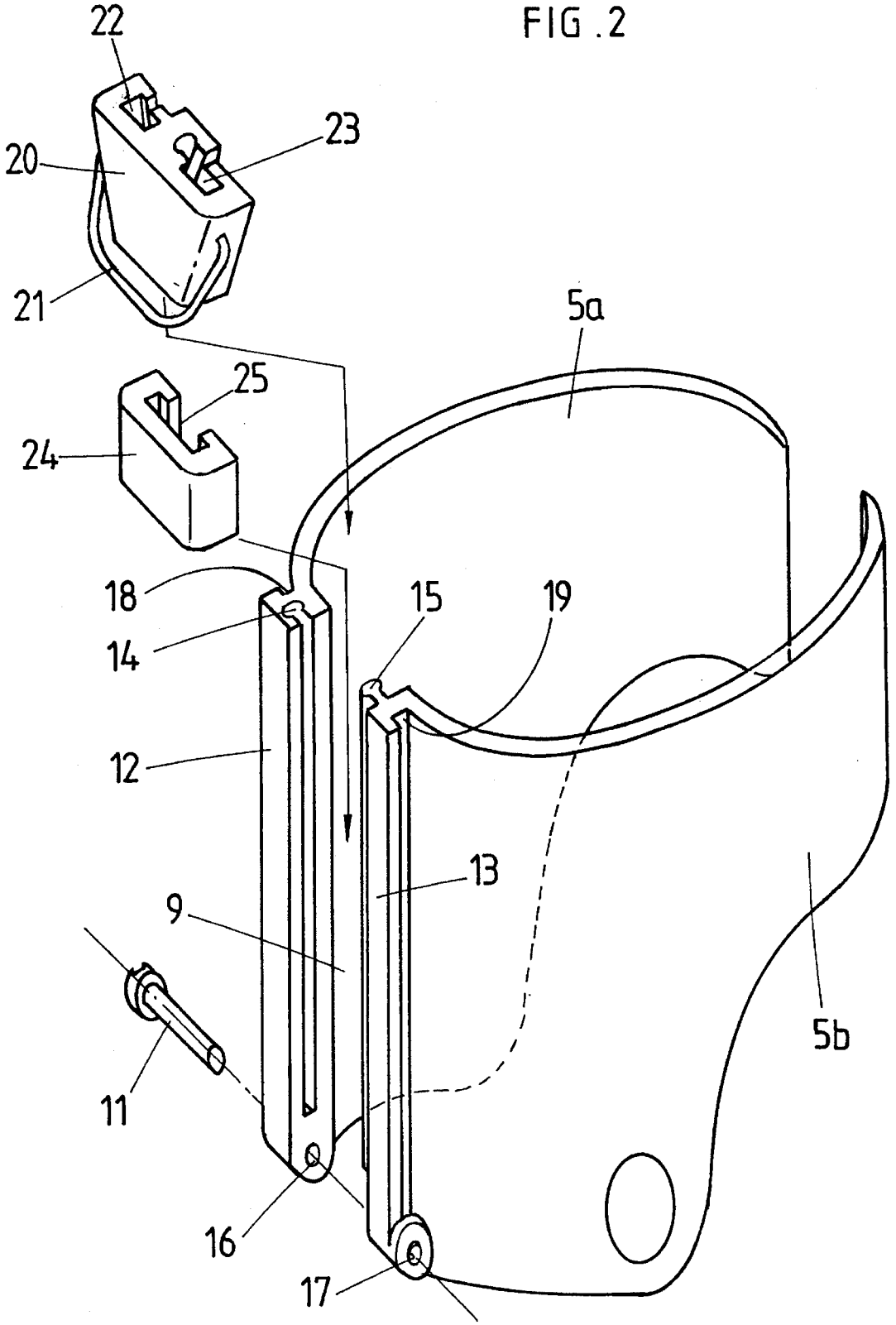
FIG. 2 represents an exploded view of the collar, without its buckles.

At the rear, the collar 5 has a slot 9 extending from the upper edge of the collar towards the heel 10 over most of the height of the collar. As FIG. 2 shows, the slot 9 is obtained by making the collar 5 from two pieces 5*a* and 5*b* which are joined together at the bottom of their rear part by means of a screw 11. This linkage might also be made by other means.

The edges of the slot 9 have an overthickness 12, 13 respectively. The overthickness 12 includes a groove 14 which is open toward the opposite edge of the slot 9 and has a female profile in the shape of a mushroom. The opposite overthickness 13 includes a rib 15 having a male profile in the shape of a mushroom which is similar to the profile 14. The groove 14 and the rib 15 extend over the entire height of the slot 9. Near its lower end, the overthickness 12 has a hole 16 for passage of the screw 11 which is screwed into a threaded hole 17 provided at the bottom of the overthickness 13. On the sides opposite the groove 14 and the rib 15, the overthicknesses 12 and 13 have a groove 18, 19 respectively into which a slide 20 hooks, which slide is fitted with a pull tab 21 for closing the slot 9 by forcible engagement of the rib 15 in the groove 14 in the manner of a zipper. For this purpose, the slide 20 has two profiled grooves 22 and 23 which converge toward the bottom of the slide. The profile of the groove 22 hooks into the grooves 14 and 18 of the overthickness 12 and the profile of the groove 23 surrounds the profile of the overthickness 13.

The overthicknesses 12 and 13 are preferably less hard than the rest of the collar 5. These overthicknesses may be moulded integrally with the collar or alternatively attached and fastened by welding or riveting. With the slot 9 open and the slide 20 in the bottom position represented in FIG. 4, the slide 20 closes the slot 9 by forcible fitting of the rib 15 into the groove 14 when this slide is pulled upward using its pull tab 21. Conversely, the groove 14 and the rib 15 are separated from each other when the slide 20 is moved back down.

The collar 5 is furthermore equipped with an auxiliary safety slide 24 having a groove 25 of T-shaped profile corresponding to the profile of the over-thicknesses 12 and 13 when assembled. When the slot 9 is closed, this safety slide 24 is placed half way up the slot 9 and prevents any accidental opening of the slot 9 under the effect of the strong forces acting on the collar 5, especially when closing the tightening buckles.

The safety slide 24 may be moved individually by hand, but it may also advantageously and simply be driven by the slide 20. It is sufficient for this purpose to connect the two slides by a flexible inextensible tie with a length such that, when the slide 20 is pulled up, this slide, after a certain travel, drives the slide 24 via the tensioned flexible tie, the length of this flexible tie being such that the safety slide 24 is automatically brought into the desired intermediate position as represented in FIG. 1. During opening of the slot 9, the slide 20 quite simply drives the safety slide 24 by pushing it in the position represented in FIG. 4.

The linkage between the slides 20 and 24 might also be provided by rigid and telescopic means.

Figure 3:
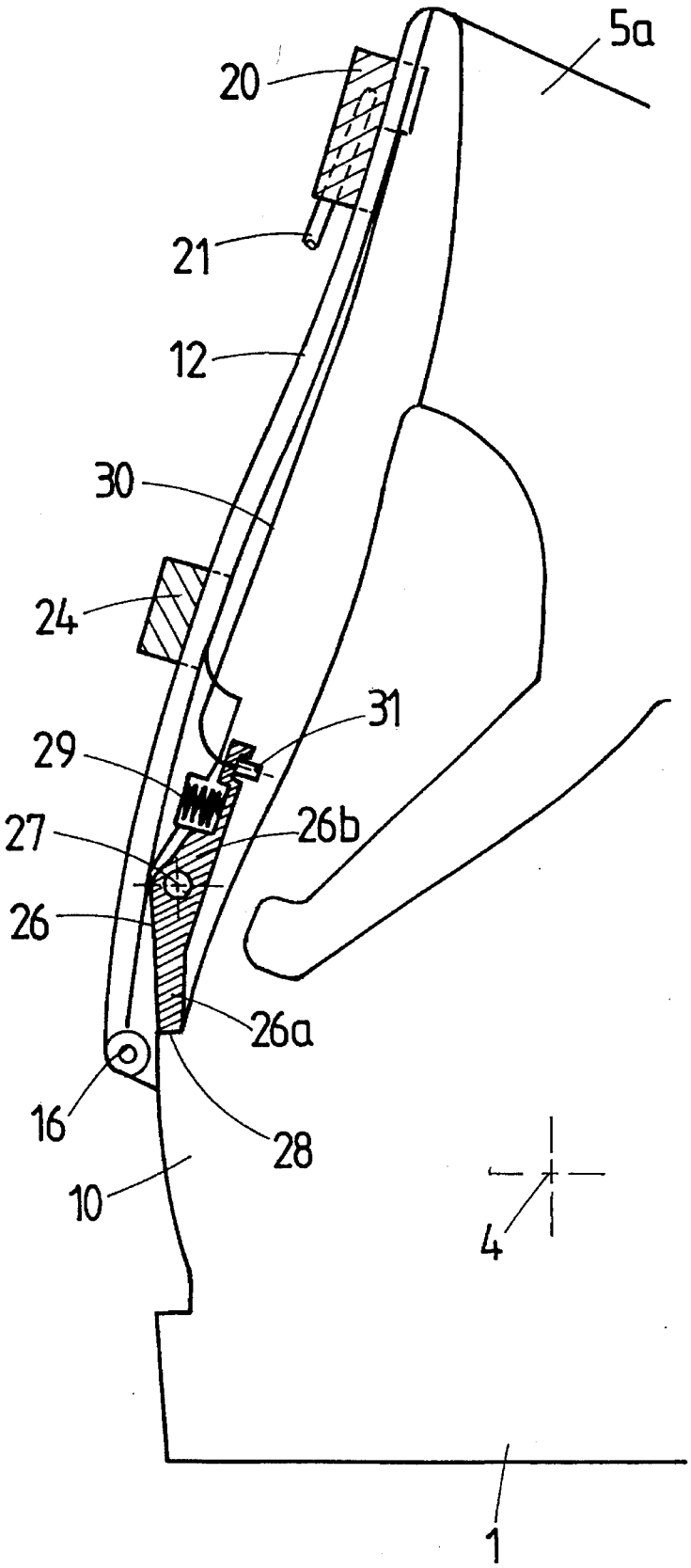
FIG. 3 is a partial view in vertical section in the junction plane of the two edges of the slot of the collar, in the same position as that represented in FIG. 1 and showing optional means for locking the collar on the lower shell.
Figure 4:
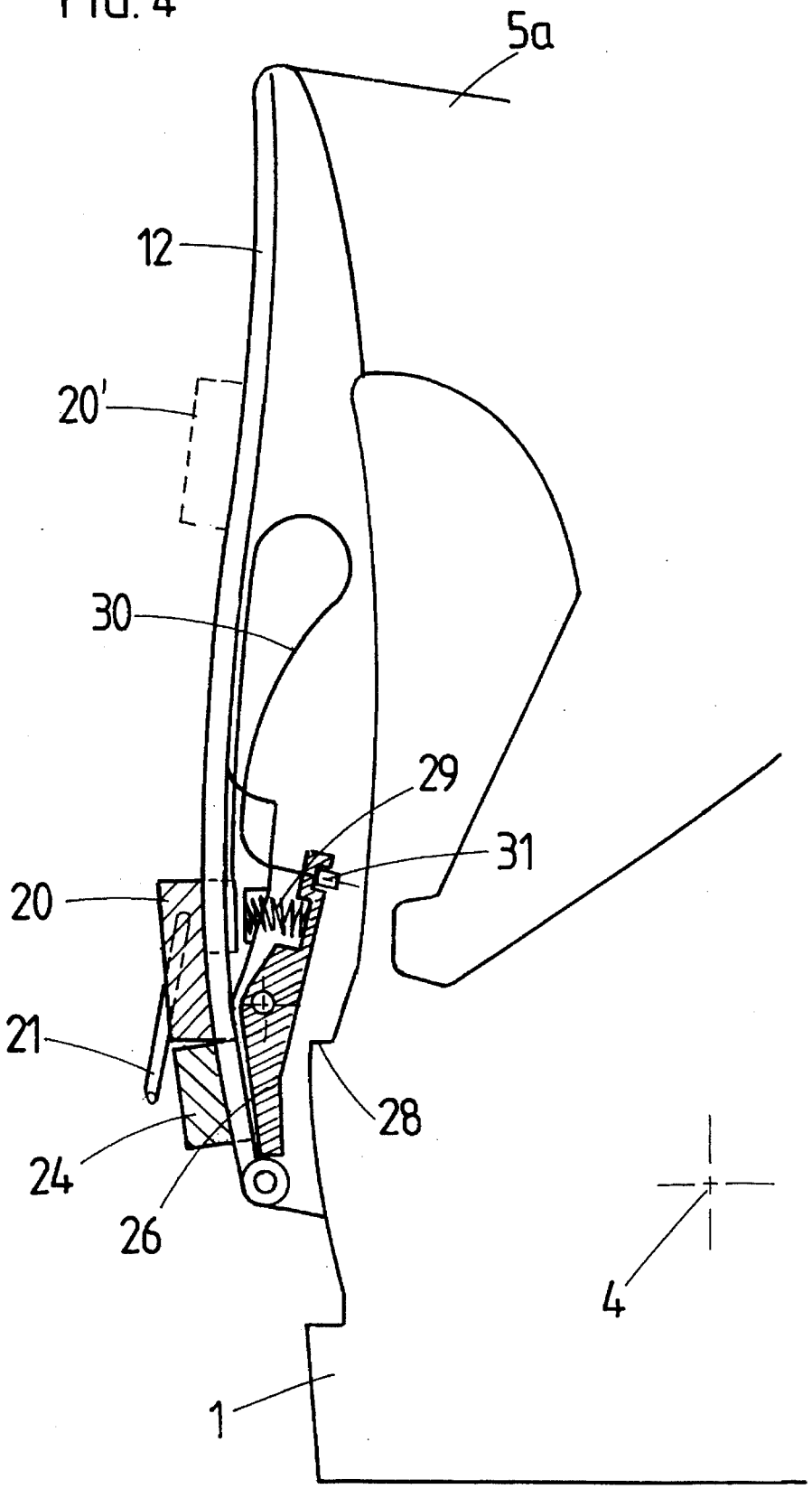
FIG. 4 is a view similar to that in FIG. 3 showing the collar in the open and unlocked position.

The closure slide 20 may advantageously be used to control a device for locking the collar onto the lower shell. One embodiment is represented in FIGS. 3 and 4. The locking device comprises a rocker arm 26 articulated onto the collar 5 transversely to the slot 9 about a pin 27 above the screw 11. This rocker arm 26 has a lower arm **26*a* interacting with a stop 28 formed on the lower shell 1 and an upper arm 26*b* onto which a spring 29, working in compression between the collar 5 and the arm 26*b*, acts. The end of the arm 26*b* is connected by a flexible inextensible tie 30 to the closure slide 20. The flexible tie 30 is for example a cable, one end of which is attached on the rocker arm 26 by a block 31** crimped onto the cable.

The spring 29 tends to hold the lower arm **26*a* against the back of the collar 5, that is to say away from the stop 28 during the pivoting of the collar 5 about its articulation 4 onto the lower shell 1. When the closure slide 20 is in its top position, represented in FIGS. 1 and 3, the flexible tie 30 is stretched and exerts a pulling force on the arm 26*b* of the rocker arm perpendicularly to the latter, whilst compressing the spring 29. The rocker arm 26 is thus held in the locking position represented in FIG. 3, the end of its arm 26*a* bearing against the stop 28**.

When the slide 20 is pushed back down, the rocker arm 26 is very rapidly released by the elimination of the tension on the flexible tie 30, and this rocker arm assumes the unlocked position represented in FIG. 4. It is thus possible to interrupt the descent of the slide 20, for example at the position 20' represented in FIG. 4, in order to obtain a walking position, that is to say a position in which the collar can be set upright and can tilt about its articulation 4 whilst regaining a good linkage between the boot and the foot of the skier. By moving the slide 20 from this position 20', it is possible to obtain optimum comfort for the lower leg during walking.

As a variant, the spring 29 might act on the arm **26*a* by holding the rocker arm in the locked position. Unlocking might be effected by a button integral with the slide 20 which would, by a wedge-shaped part, separate the arm 26*b*** from the collar.

I claim:

1. A ski boot with a shell for a skier's foot comprising a lower shell having a front and a heel (1) intended to surround the foot and a boot leg (5) having a rear and an upper edge being in the form of a collar which is articulated on the lower shell and fitted, at the front, with at least one closure and tightening device (6, 7), wherein the boot leg has, at the rear, at least one slot (9) having edges and extending, from the upper edge of the boot leg, over most of the height of the boot leg, toward the heel, the edges of the slot having an overthickness (12, 13), the overthickness (13) of one of the edges having a male profile (15) and the overthickness (12) of the other edge having a matching female profile (14), so as to ensure mutual fastening of its edges by forcible engagement of the male profile into the female profile, and wherein the boot leg includes a closure slide (20) slidingly mounted astride the said edges, the displacement of the slide along said slot closes and opens the slot in the manner of a zipper, a device (26) at the rear for locking the boot leg on the shell, in a forward inclined position, wherein this device (26) being connected to the closure slide (20) by a linkage member (30) such that the device is unlocked when the slide occupies it's topmost position on the boot leg.

2. The ski boot as claimed in claim 1, wherein the overthicknesses (12, 13) of the edges of the slot are less hard than the boot leg.

3. The ski boot as claimed in claim 1, wherein the boot leg consists of two collar halves (**5*a*, 5*b*) connected by the bottom of their rear part by permanent linkage means (11**).

4. The ski boot as claimed in claim 1, wherein a safety slide (24) is arranged below the closure slide.

5. The ski boot as claimed in claim 4, wherein means are provided for limiting the travel of the safety slide (24) at a point situated approximately half way up the slot (9).

6. The ski boot as claimed in claim 1, wherein the locking device consists of a rocker arm (26) articulated on the boot leg about a pin (27) transverse to the slot, the lower arm (**26*a*) of which interacts with a stop (28) integral with the lower shell, and a spring (29) acting on the other arm of the rocker arm for holding it away from the stop, wherein the upper arm (26*b*) of the rocker arm is connected to the closure slide (20) by a flexible inextensible tie (30) whose length is such that the rocker arm is separated from the stop by the pulling force on the flexible tie when the closure slide (20**) occupies its topmost position on the boot leg.

7. A ski boot with a shell for a skier's foot comprising a lower shell having a front and a heel (1) intended to surround the foot and a boot leg (5) having a rear and an upper edge being in the form of a collar which is articulated on the lower shell and fitted, at the front, with at least one closure and tightening device (6, 7), wherein the boot leg has, at the rear, at least one slot (9) having edges and extending, from the upper edge of the boot leg, over most of the height of the boot leg, toward the heel, the edges of the slot having an overthickness (12, 13), the overthickness (13) of one of the edges having a male profile (15) and the overthickness (12) of the other edge having a matching female profile (14), so as to ensure mutual fastening of its edges by forcible engagement of the male profile into the female profile, and wherein the boot leg includes a closure slide (20) slidingly mounted astride the said edges, the displacement of the slide along said slot closes and opens the slot in the manner of a zipper, a safety slide (24) being arranged below the closure slide, means being provided for limiting the travel of the safety slide (24) at a point situated approximately half way up the slot (9), the two slides (20, 24) being connected by a flexible linkage member simultaneously constituting means for driving the safety slide (24) by the closure slide (20) and the means for limiting the travel of the safety slide.

8. A ski boot with a shell for a skier's foot comprising a lower shell having a front and a heel (1) intended to surround the foot and a boot leg (5) having a rear and an upper edge being in the form of a collar which is articulated on the lower shell and fitted, at the front, with at least one closure and tightening device (6, 7), wherein the boot leg has, at the rear, at least one slot (9) having edges and extending, from the upper edge of the boot leg, over most of the height of the boot leg, toward the heel, the edges of the slot having an overthickness (12, 13), the overthickness (13) of one of the edges having a male profile (15) and the overthickness (12) of the other edge having a matching female profile (14), so as to ensure mutual fastening of its edges by forcible engagement of the male profile into the female profile, and wherein the boot leg includes a closure slide (20) slidingly mounted astride the said edges, the displacement of the slide along said slot closes and opens the slot in the manner of a zipper, a safety slide (24) being arranged below the closure slide, means being provided for limiting the travel of the safety slide (24) at a point situated approximately half way up the slot (9), the two slides being connected together by telescopic linkage means simultaneously constituting means for driving the safety slide by the closure slide and the means for limiting the travel of the safety slide.

* * * * *